US005295376A

United States Patent [19]

Myers

[11] Patent Number: 5,295,376

[45] Date of Patent: Mar. 22, 1994

[54] ZERO CLEARANCE LOCK

[75] Inventor: Gary L. Myers, River Grove, Ill.

[73] Assignee: Fort Lock Corporation, River Grove, Ill.

[21] Appl. No.: 52,576

[22] Filed: Apr. 22, 1993

[51] Int. Cl.[5] ..... E05B 27/00

[52] U.S. Cl. ..... 70/369; 70/373; 70/375; 70/379 R; 70/386; 70/421; 70/422; 70/DIG. 30; 70/DIG. 62

[58] Field of Search ..... 70/386, DIG. 62, DIG. 30, 70/358, 373, 375, 356, 492, 367-369, 379 R, 421, 422, 438, 464, DIG. 37

[56] References Cited

U.S. PATENT DOCUMENTS

| | | | |
|---|---|---|---|
| 1,977,189 | 10/1934 | Larson et al. | 70/DIG. 37 X |
| 4,381,656 | 5/1983 | Hayakawa | 70/370 X |
| 4,715,201 | 12/1987 | Craig | 70/373 X |
| 4,890,467 | 1/1990 | Krause et al. | 70/369 |
| 4,956,983 | 9/1990 | Okamura et al. | 70/DIG. 30 X |
| 5,040,652 | 8/1991 | Fish et al. | 70/386 X |
| 5,121,618 | 6/1992 | Scott | 70/386 X |

FOREIGN PATENT DOCUMENTS

| | | | |
|---|---|---|---|
| 1187515 | 2/1965 | Fed. Rep. of Germany | 70/379 R |
| 655095 | 7/1963 | Italy | 70/371 |
| 0066052 | 4/1982 | Japan | 70/237 |
| 879297 | 10/1959 | United Kingdom | 70/492 |

*Primary Examiner*—Lloyd A. Gall
*Attorney, Agent, or Firm*—Leydig, Voit, Mayer, Ltd.

[57] ABSTRACT

A combinating tumbler lock featuring zero clearance between the lock plug and mounting shell including: a mounting shell having a central throughbore with a front section having a first, greater diameter and including longitudinal locking grooves, a rear section having a second smaller diameter and including longitudinal stopping grooves, and a tapered transition section between the front and rear sections; a lock plug for selective rotation within the mounting shell and having three sections corresponding in diameter to the sections in the mounting shell, the lock plug front section including a tumbler receiving opening, the lock plug rear section including a cam-receiving structure and a first radial throughbore, the lock plug also including a second radial throughbore between the front section and the tapered section; a tumbler disposed in the lock plug for selective engagement with the longitudinal locking grooves of the shell; a spring loaded stop comprising two spherical balls actuated by a compression spring disposed within the first radial throughbore to provide positive stop positioning and feel by selective engagement with the stopping grooves; and a spring loaded bearing in the form of two spherical balls actuated by a compression spring and disposed within the second radial throughbore.

13 Claims, 1 Drawing Sheet

ZERO CLEARANCE LOCK

BACKGROUND OF THE INVENTION

1. Field of the Invention

This invention relates generally to the field of combinating tumbler locks, and more particularly to panel mounted tumbler locks for electrical equipment.

2. Description of the Prior Art

There are many locking applications where an inexpensive and reliable combinating tumbler lock is desired. Many such combinating tumbler locks are in the prior art. However, many of these have drawbacks which make them undesirable as they are either too expensive or do not give adequate performance.

A common problem with combinating tumbler locks is a rough operation between various stopped positions, illustratively the locked and unlocked positions. This rough operation makes these locks inconvenient to use and also can result in difficulty in locating the various stops. In electrical applications, where the lock is used to actuate a switch, such difficulty in positioning can lead to the undesirable result that the switch will not be actuated at the position where the operator expects actuation. This rough operation is usually a result of frictional contact between the lock plug, which houses the combinating tumblers, and the lock shell.

One solution to rough operation is to increase the clearance between the plug and the shell. This increased clearance, however, can lead to undesirable play between the plug and shell. Further, this clearance can lead to security problems, as the lock becomes subject to pull out as well as punch out.

The problem of inaccurate positioning is often solved by engageable detents on the lock plug and lock shell. These detents are arranged such that they will engage when the shell is rotated to a particular stop position, thereby preventing further rotation of the plug and providing accurate positioning. However, such detents limit the adaptability of the lock to various applications. Often, electrical switch locks have more than one stop position, which is not compatible with the use of detents. Further, use of detents means that the lock has a preferred orientation. If the application requires a twelve o'clock locked position and a three o'clock unlocked position, the lock with detents must be oriented accordingly. This can lead to delay, inaccuracy and inconvenience in installation. It would thus be desirable to have a lock that provides for accurate stop positioning but that allows for more than one stop position and does not have a preferred orientation.

As with all locks, ease of construction and assembly are desirable features; as is inexpensive cost of manufacture and resistance to tampering.

SUMMARY OF THE INVENTION

Accordingly, it is a primary object of the present invention to overcome the deficiencies in the existing combinating tumbler locks described above and to provide a tumbler lock that combines smooth operation with positive stop positioning while also providing essentially zero clearance between the lock plug and lock shell.

It is a related object to provide a tumbler lock with positive indication and feel of the various stop positions.

It is an additional object to provide positive stop positioning without need for detent means.

It is a related object to provide for stop positioning that does not depend on the orientation of the lock.

It is an additional object to provide bearing between the lock plug and the lock shell to allow for the essentially zero clearance.

It is a related object to provide a lock with smooth operation yet still maintaining high securing against pull out or punch out.

It is an additional object to provide a lock that is low in cost to manufacture and easy to assemble.

In accordance with these and other objects, there is provided a novel lock construction primarily for use in panel mounted applications in electrical equipment, or the like, where space is limited. This cam lock combines low cost of manufacture and assembly with a simple construction that incorporates the feature of positive indication and feel of various stop positions of the key plug within the lock shell. In addition, rotation of the plug within the shell is easy and smooth operating while providing the positive feel and location of the plug at the various stop positions corresponding to selected cam positions. The lock achieves the smooth operation with an essentially zero clearance between the lock plug and shell. This manner of interfit of the components provides security against pull out as well as punch out while still retaining simplicity of construction. Overall, the lock is a simple, yet highly functional and low cost cam lock.

DETAILED DESCRIPTION OF THE PREFERRED EMBODIMENT

While the invention will be described in connection with a particular preferred embodiment, it will be understood that it is not intended to limit the invention to that particular embodiment. On the contrary, it is my intention to cover all alternatives, modifications, and equivalences which may be included within the spirit and scope of the invention as defined by the appended claims.

Figure 1:
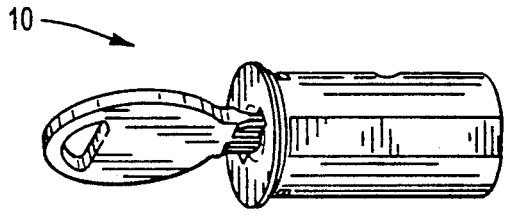
FIG. 1 is an elevational view of one embodiment of the zero clearance lock of the present invention.

Turning to the drawings, there is shown in FIG. 1 a zero clearance lock 10 manufactured in accordance with the present invention. As can be seen from FIG. 1, the assembled lock presents a very sleek profile that is essentially cylindrical in shape. This allows for easy insertion of the assembled lock into a panel mounting or the like.

Figure 3:
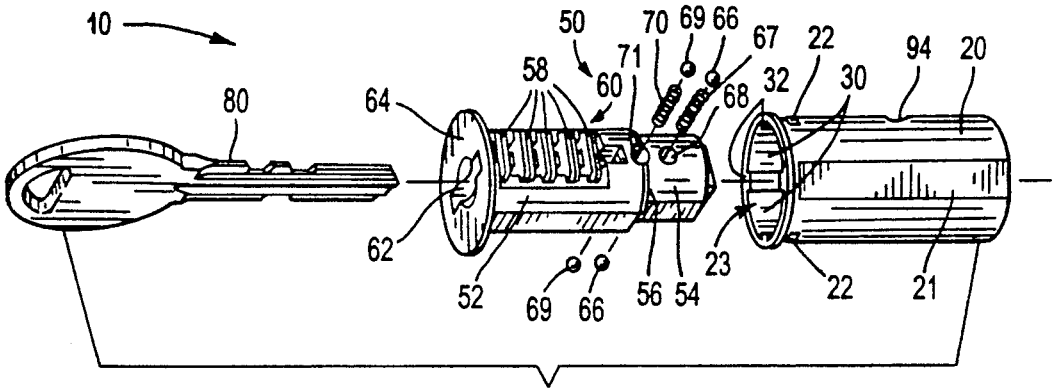
FIG. 3 is an exploded view of one embodiment of the zero clearance lock.

An exploded view of the zero clearance lock 10 of the present invention is depicted in FIG. 3. As can be seen from that figure, the lock is composed of relatively few parts which can be easily assembled to form the completed lock. These parts include a mounting shell 20 which has a substantially smooth cylindrical outer surface, and a central throughbore 23. Central throughbore 23 is adapted to receive a lock plug 50. The lock plug 50 is designed to have essentially zero clearance between its outer surface and the interior of the mounting shell 20, as will be discussed in greater detail below. In turn, the lock plug 50 includes a tumbler receiving opening for receiving tumbler means to provide for selective rotation of the lock plug 50 within the mounting shell 20. This selective rotation is controlled by means of a properly coded key 80. The key 80 actuates the tumblers disposed within the lock plug 50 to provide for the selective rotation of the lock plug 50 within the mounting shell 20.

To facilitate mounting of the mounting shell 20 into a panel mounting or the like, the mounting shell 20 may be adapted to receive a panel mounting clip, or the like. The mounting shell 20 includes longitudinal flats 21 for receiving the extending legs of the clip. Also included are recesses 22 for receiving a center tab of the clip. On skilled in the art will appreciate that several other means of mounting the mounting shell 20 in a panel or the like could be used including, but not limited to, threading the shell 20 and mounting it with a conventional nut and washer.

Figure 4:
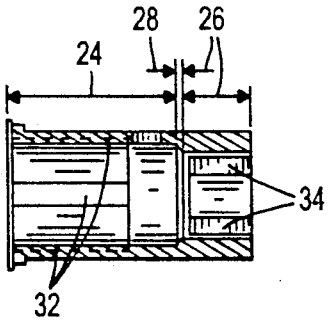
FIG. 4 is a section view of the mounting shell in one embodiment of the zero clearance lock.

To provide for essentially zero clearance between the lock plug 50 and the mounting shell 20, both of these components have front and rear sections of differing diameters with a tapered transition section between the front and rear sections. For the mounting shell, this can be seen most clearly in the sectional view shown in FIG. 4. The front section 24 has a first greater diameter, while the rear section 26 has a second, smaller diameter. Between these two sections is a tapered transition section 28. The two diameters 25 and 27 are shown clearly in FIG. 6. In the present embodiment, the greater diameter 25 is that from the center of the mounting shell 20 to the detents 32. It will be appreciated that the locking grooves 30 have a larger diameter. The smaller diameter is between the center of the shell 20 and the areas of the shell 20 between stopping grooves 34. In a like manner to the mounting shell 20, and as shown in FIG. 3, the lock plug has a front section 52 which has a diameter substantially equal to the first, greater diameter of the front section 24 of the mounting shell. The lock plug 50 also includes a rear section 54 having a diameter substantially equal to the second, smaller diameter of the rear section 26 of the mounting shell 20. The lock plug 50 also includes a tapered transition section 56 between the front section 52 and rear section 54. The design of the lock plug 50 is adapted so that, when it is in place inside the mounting shell 20, there is essentially zero clearance between the lock plug 50 and the interior of the mounting shell 20.

To provide for selective rotation of the lock plug 50 within the mounting shell 20, the zero clearance lock 10 as shown in FIG. 3 includes tumbler means 58 in the lock plug 50 which engage with longitudinal lock grooves 30 in the mounting shell 20. The tumbler means 58 are disposed in a tumbler receiving opening 60 located in the lock plug 50. In the present embodiment, the tumbler means 58 are conventional combinating tumblers which are paired for use with a double bitted key 80. In a conventional fashion, the tumblers 58 are normally biased outward beyond the perimeter of the lock plug 50 and into engagement with the longitudinal locking grooves 30 in the mounting shell 20. The locking grooves 30 are separated by longitudinally running detents 32. In the present embodiment, the longitudinal detents 32 are separated by 90 degrees around the circumference of the mounting shell 20. The orientation of the detents 32 and locking grooves 30 can be seen most clearly in FIG. 6. When the tumblers 58 are in the outwardly biased position and are engaged with the longitudinal locking grooves 30, the lock plug 50 cannot rotate within the mounting shell 20. However, when the tumblers 58 are actuated by a properly coded doubled bitted key 80, they withdraw into the tumbler receiving opening 60 until they are flush with the exterior surface of the lock plug 50. When in this position, the tumblers 58 are no longer engaged with the longitudinal locking grooves 30 and the lock plug 50 is free to rotate within the mounting shell 20. The key 80 is inserted through a keyslot 62 which is centrally located in a circular flange 64 attached to the front section of the lock plug 50. When the lock plug 50 is fully inserted into the mounting shell 20, the circular flange 64 engages the front end of the mounting shell 20.

To provide for positive stop positioning, and positive feel at the stop positions, the zero clearance lock 10, as shown in FIG. 3 includes a spring loaded stop means disposed within the lock plug for selective engagement with longitudinal stopping grooves 34 in the mounting shell 20. In the present embodiment, the spring loaded stop means is in the form of spherical balls 66 as actuated by a spring 67. The spherical balls 66 and spring 67 are adapted to be received within a first radial throughbore 68 located in the rear section 54 of the lock plug 50. The longitudinal throughbore 68 can be seen more clearly in the cross-sectional view of FIG. 5. That figure reveals that the throughbore 68 is essentially dumbbell shaped having a small diameter central portion for receipt of the spring and greater diameter end portions for receipt of the spherical balls 66. In the present embodiment, the throughbore 68 is oriented to be parallel to the keyslot 62. However, any other orientation could also be used, such as the throughbore 68 being perpendicular to the keyslot 62.

Figure 6:
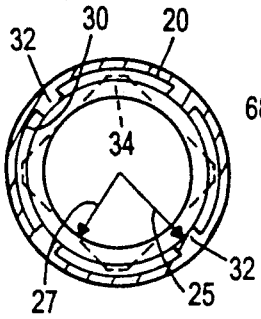
FIG. 6 is a section view showing the relationship of the locking grooves and stopping grooves of one embodiment of the zero clearance lock.
Figure 7:
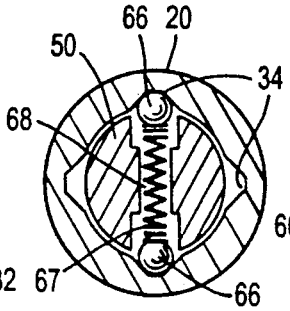
FIG. 7 is a section view showing the function of the spring-loaded stop means of one embodiment of the zero clearance lock.
Figure 8:
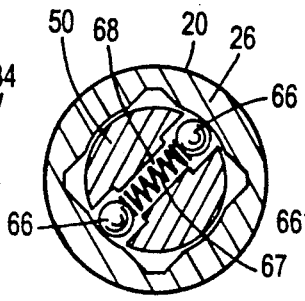
FIG. 8 is a section view showing the function of the spring-loaded stop means of one embodiment of the zero clearance lock.
Figure 9:
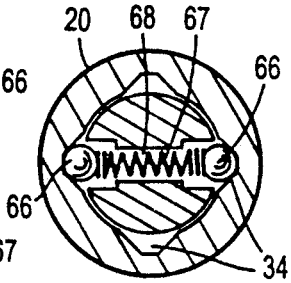
FIG. 9 is a section view showing the function of the spring-loaded stop means of one embodiment of the zero clearance lock.

The longitudinal stopping grooves 34 with which the spring loaded stop means engage can be seen in phantom in the section view of FIG. 6. These stopping grooves 34 are separated by 90 degrees about the circumference of the rear section 26 of the mounting shell 20. The orientation of the stopping grooves 34, and the interaction between the stopping grooves 34 and the spring loaded stop means to provide the positive stop feature, can be seen most clearly in reference to FIGS. 7–9 showing a section view of the rear portion of the assembled lock. For the purposes of those figures, it is assumed that the double bitted key 80 has actuated tumblers 58 such that the lock plug 50 is otherwise free to rotate within the mounting shell 20.

FIG. 7 shows the lock plug 50 at one of the stopped positions within the mounting shell 20. The spring 67 biases the spherical balls 66 into engagement with the stopping grooves 34 in this position. FIG. 8 shows the lock plug 50 as it is being rotated between stop positions within the mounting shell 20. As can be seen from that figure the spherical balls 66 maintain contact with the inner surface of the mounting shell 20. Since the inner surface of the mounting shell 20 between the stop grooves 34 is of a smaller diameter than the stop grooves 34, the spherical balls 66 are pushed into the recesses of the centrally located throughbore 68 as the lock plug is rotated away from a stop position. As rotation of the lock plug 50 continues, the lock plug 50 will arrive at the position to depicted in FIG. 9, another stop position. As the lock plug 50 approaches the stop position, the bias of the spring 67 pushes outwardly on the spherical balls 66 causing them to positively engage with the stopping grooves 34. Because the spherical balls 66 roll along the interior surface of the mounting shell 20, the rotation between stop positions is smooth. Further, because the spring 67 biases the spherical balls 66 into engagement with the stopping grooves 34 there is a positive stop feel at the stop positions. This is beneficial to the user as he can easily detect the stop positions by this positive feel, and the lock does not have to employ other disadvantageous mechanical means such as detents for the purpose of giving a positive stop. Further, since detents are not employed, the mounting shell 20 need not be set in a specific orientation to give stops at desired positions. For instance, if it is desired to have stops every quarter rotation, the mounting shell 20 of the present invention could be mounted in any of four orientations, so long as one stop groove 34 is pointing upward. A wide variety of stop positionings could be achieved by modifying the orientation of stopping grooves 34. In the present embodiment, the stopping grooves 34 are diametrically opposed since the spherical balls 66 are also oriented that way. However, other configurations may be used. For example, a single spring-actuated ball could be placed in a closed end throughbore 68. In such a configuration only single, as opposed to paired stopping grooves, would be required.

To facilitate the coordination of the stop positions with the positions where the key may be inserted or withdrawn, the lock grooves 30 and the stopping grooves 34 are in registration. The registration for the present embodiment is seen most clearly in FIG. 6. In a conventional manner, the key 80 can only be withdrawn when the lock plug 50 is oriented such that the tumblers 58 are adjacent a lock groove 30. Thus, the stop positions are selected such that the tumblers 58 will be in this orientation only when the lock plug 50 is rotated to a stop position where withdrawal of the key is desirable. In the present embodiment, the registration is such that the key may be withdrawn at any of the stop positions. It may be desirable to have some stop positions where the key can be withdrawn and some where it cannot. To prevent withdrawal of the key at a certain stop position, the mounting shell would be designed such that the tumblers 58 would not be adjacent a locking groove 30 when in that stop position, as defined by the position of the stop grooves 34. A variety of registrations between the locking grooves 30 and stopping grooves 34 can be used to achieve desired results.

To provide for smoothness of operation despite the essentially zero clearance between the lock plug 50 and mounting shell 20, there is provided a spring loaded bearing means in the zero clearance lock 110 of FIG. 3 and according to the present invention. In the present embodiment, the spring loaded bearing means is in the form of two spherical balls 69 as actuated by spring 70. In a similar fashion to the spring loaded stop means, the spring loaded bearing means is disposed within a second radial throughbore 71 located between the front section 52 and the tapered transition section 56 of the lock plug 50. The second radial throughbore 71 can be seen most clearly in FIG. 3. As with the first radial throughbore 68, the second radial throughbore 71 is dumb-bell shaped, with a central portion of a smaller diameter for containing the spring 70 and end portions of a larger diameter for containing spherical balls 69.

Figure 5:
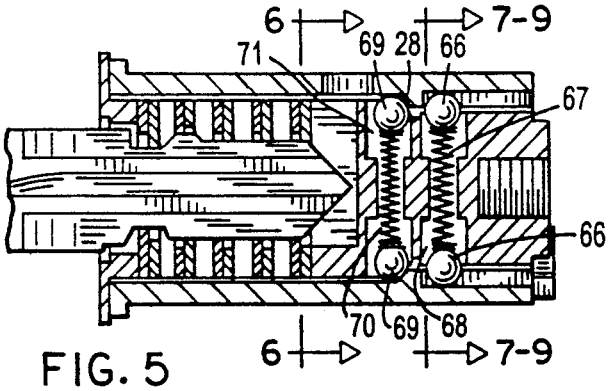
FIG. 5 is a section view of the lock plug and mounting shell in one embodiment of the zero clearance lock.

The operation of the spring loaded bearing means can be seen most clearly in FIG. 5. The spherical balls 69 are continually biased outward by the spring 70 such that they always engage the interior surface of the mounting shell 20. Because of the position of the second longitudinal throughbore 71, the spherical balls 69 bear against both the first section 24 of the mounting shell 20, and the tapered transition section 28 of the mounting shell 20. This results in sufficient bearing between the lock plug 50 and the mounting shell 20 in both radial and longitudinal directions. At the same time, the tapered sections of the lock plug 50 and the mounting shell 20 cooperate to prevent punch-out of the lock. Any attempted punch out would cause these two surfaces to engage. Thus the lock 10 has this safety feature while the spring loaded bearing means insures that, even With this feature, the lock still has smooth operation.

Figure 2:
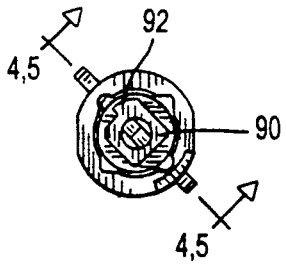
FIG. 2 is an end view of the cam-receiving end of one embodiment of the zero clearance lock.

For receiving a cam or other actuation device, the zero clearance lock includes a cam-receiving means on the rear section of the lock plug 50. The cam-receiving means according to the present invention can be seen most clearly in FIG. 2. There, it can be seen that the cam-receiving means 90 is a rectangular solid that is essentially square in shape, but having an engaging detent 92. The engaging detent 92 can be used for selective engagement with a similar slot in a cam. The interior of the cam-receiving means 90 is also threaded to make attachment of a cam simpler. It would be appreciated by one skilled in the art that any variety of actuation means may be associated with the zero clearance lock of the present invention. Included within the scope of this invention would be both mechanical cam-type locks and electrical switch locks.

The zero clearance lock of the present invention is also easy to assemble, as facilitated by the novel spring loaded stop means and spring loaded bearing means. The means of construction is also facilitated by an assembly hole 94 located in the mounting shell 20, as seen in FIG. 3. This mounting hole 94 is large enough to allow passage both of the compression springs 67 and 70, and of the spherical balls 66 and 69.

A lock plug in which the tumblers have already been disposed can easily be assembled into the mounting shell 20 in the following manner. The lock plug 50 is inserted in the mounting shell 20 until the first longitudinal throughbore 68 is even with the assembly hole 94. A first spherical ball 66 is placed through the hole, and comes to rest in an end recess of the dumb-bell shaped first radial throughbore 68. The lock plug 50 is then rotated 180 degrees until the other end recess of the throughbore 68 is beneath the assembly hole 94. The spring 67 is then inserted followed by the other spherical ball 66. The spherical ball 66 is then pushed inward beyond the edge of the assembly hole 94 until the lock plug 50 can be rotated within the mounting shell 20. Upon rotation of the lock plug 50 away from the assembly hole 94, the two steel balls 66 are captured by the mounting shell 20. The lock plug 50 can now be advanced further into the mounting shell 50 until the second radial throughbore 71 is at the position of the assembly hole 94. The same procedure is then repeated for the spherical balls 69 and compression spring 70. The lock plug 50 is then further advanced within the mounting shell 20 until the spherical balls 66 engage the tapered transition section 28 of the mounting shell 20. At that point the spring 67 is compressed and the steel balls 66 move radially inwardly as directed by the sloped walls of the transition section 28. Upon passing the transition section, the steel balls snap outwardly into stop grooves 34 to the position shown in FIG. 5. At this point, the lock is fully assembled. In a similar fashion, disassembly of the lock for the purpose of changing the tumblers or the like is also simple. The lock plug need only be rotated to a position such as that in FIG. 8 where the spherical balls 66 are intermediate stopping positions. As can be seen most clearly from FIG. 6, there is no wall preventing withdrawal of the lock plug from the mounting shell at this position. It is assumed, of course that any cam or actuating means attached to the lock have been removed prior to this operation. The lock plug can now simply be pulled toward the front section such that the spherical balls 66 pass the tapered transition section 28 of the mounting shell 20. Once this has occurred, the lock plug can be fully withdrawn from the mounting shell 20 to facilitate recoding of the tumblers or the like.

The zero clearance lock described herein thus provides smooth operation and positive stop positioning while also providing essentially zero clearance between the lock plug and mounting shell. This in turn leads to reliable operation and added security. Further, the use of a spring-loaded stop means in conjunction with stopping grooves allows the lock to be installed in a variety of orientations while still functioning properly. Finally, the lock is easy to manufacture and assemble and is low in cost while providing reliable and secure performance.

What is claimed is:

1. A zero-clearance lock, comprising in combination:

a mounting shell having a substantially smooth cylindrical surface, a central throughbore including a front section having a first, greater diameter, a rear section having a second, smaller diameter, and a tapered transition section between said front and rear sections, the front section including longitudinal locking grooves, and the rear section including longitudinal stopping grooves;

a lock plug for selective rotation within said mounting shell, said lock plug having a substantially smooth cylindrical outer surface, a front section with a diameter substantially equal to said first diameter, a rear section with a diameter substantially equal to said second diameter and a tapered transition section between said front and rear sections;

said lock plug front section including a tumbler-receiving opening, and a circular flange including a centrally located keyslot;

said lock plug rear section including a cam-receiving means and a first radial throughbore;

said lock plug including a second radial throughbore between said front section and said tapered transition section;

a tumbler means disposed in said tumbler-receiving opening for selective engagement with said longitudinal locking grooves, said tumbler means including coding for actuation by a properly coded key for disengagement from said locking grooves to allow for said selective rotation of said lock plug;

a spring-loaded stop means disposed within said first radial throughbore for selective engagement with said stopping grooves upon rotation of said lock plug; and a spring-loaded bearing means disposed within said second radial throughbore for maintaining clearance between the first and transition sections of said lock plug and said mounting shell during rotation of said lock plug.

2. The zero-clearance lock according to claim 1, wherein said stop means includes diametrically opposed spherical balls actuated by a compression spring disposed between said spherical balls and within said first radial throughbore.

3. The zero-clearance lock according to claim 2, wherein the first radial throughbore is dumbbell-shaped, having a smaller diameter central portion for receipt of the spring and greater diameter end portions for receipt of the spherical balls.

4. The zero-clearance lock according to claim 3, wherein the longitudinal stopping grooves are diametrically opposed within said mounting shell.

5. The zero-clearance lock according to claim 4, wherein the interaction between the spherical balls and the longitudinal stopping grooves defines specific stop positions, such that the orientation of the longitudinal stopping grooves defines the stop positions.

6. The zero-clearance lock according to claim 5, wherein the longitudinal locking grooves and the longitudinal stopping grooves are in registration.

7. The zero-clearance lock according to claim 1, wherein said bearing means includes diametrically opposed spherical balls actuated by a compression spring disposed between said spherical balls and within said second radial throughbore.

8. The zero-clearance lock according to claim 7, wherein the second radial throughbore is dumbbell-shaped, having a smaller diameter central portion for receipt of the spring and greater diameter end portions for receipt of the spherical balls.

9. The zero-clearance lock according to claim 1, wherein said substantially cylindrical mounting shell includes two diametrically opposed flat regions, and diametrically opposed mounting indentations.

10. The zero-clearance lock according to claim 9, wherein the mounting shell is adapted to be secured within a panel mount.

11. The zero-clearance lock according to claim 10, wherein the lock does not have a preferred orientation.

12. The zero-clearance lock according to claim 1, wherein the cam-receiving means is a rectangular solid including an engaging detent at one corner of said rectangle.

13. The zero-clearance lock according to claim 1, wherein said mounting shell includes an assembly hole.

* * * * *